United States Patent [19]

Livesay

[11] 4,247,149

[45] Jan. 27, 1981

[54] MECHANICALLY ACTUATED IMPACT MECHANISM

[75] Inventor: Richard E. Livesay, Peoria, Ill.

[73] Assignee: Caterpillar Tractor Co., Peoria, Ill.

[21] Appl. No.: 973,046

[22] Filed: Dec. 11, 1978

[51] Int. Cl.[3] ..... E21C 27/46; D21D 9/10; D02D 7/06

[52] U.S. Cl. ..... 299/70; 173/13; 173/51; 173/101; 173/123; 299/62

[58] Field of Search ..... 299/37, 62, 31, 69, 299/70, 34; 173/13, 51, 101, 123; 172/40; 37/DIG. 18; 74/54

[56] References Cited

U.S. PATENT DOCUMENTS

| | | | |
|---|---|---|---|
| 976,703 | 11/1910 | Seberg et al. | 299/62 |
| 1,116,355 | 11/1914 | Morgan | 299/31 |
| 1,399,387 | 12/1921 | Jackson | 173/94 |
| 1,676,097 | 7/1928 | Lang | 299/64 X |
| 2,619,338 | 11/1952 | Lindgren | 299/64 X |
| 3,162,252 | 12/1964 | Cobi | 173/91 |
| 3,280,924 | 10/1966 | Pavlovich | 173/49 |
| 3,583,497 | 6/1971 | Kossowski et al. | 173/49 |
| 3,813,126 | 5/1974 | Rogne et al. | 299/33 |
| 3,868,145 | 2/1975 | Cobb et al. | 299/37 |
| 4,045,088 | 8/1977 | Bechem | 299/31 |

FOREIGN PATENT DOCUMENTS

| | | | |
|---|---|---|---|
| 1205028 | 11/1965 | Fed. Rep. of Germany | 299/34 |

*Primary Examiner*—Ernest R. Purser

*Attorney, Agent, or Firm*—Wegner, Stellman, McCord, Wiles & Wood

[57] ABSTRACT

An impact mechanism for rock breaking, pile driving and pile extracting, and the like, includes a head assembly (18) with a pair of shank members (24,26) movably mounted thereto and flywheel (76,78) and eccentric crankshaft parts (74) rotated by a motor (84). The crankshaft parts (74) intermittently contact one of the shank members (24,26) to drive it outwardly from the head assembly (18) by transmitting flywheel energy thereto. A biasing and dampening device (110) associated with each shank member (24,26) absorbs rebound energy from the shank member (24,26) and maintains the shank members (24,26) disengaged from the crankshaft parts (74) until it is positively urged thereagainst. The head assembly (18) is movably mounted at the end of an articulated arm (10) for maneuvering it into desired work position.

11 Claims, 7 Drawing Figures

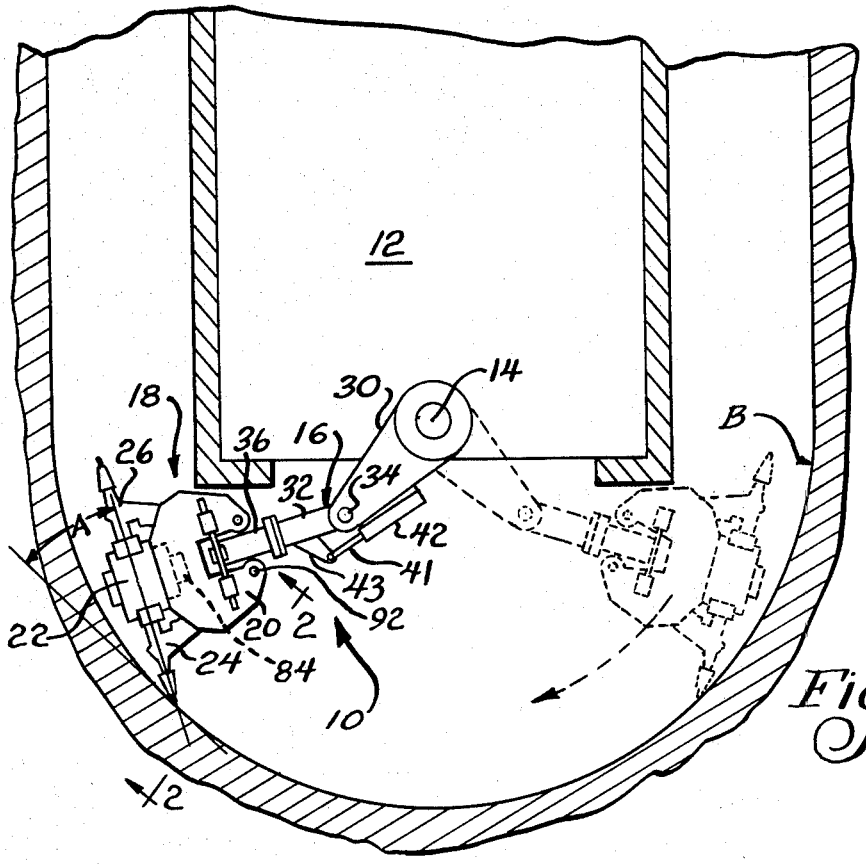
Fig. 1
Fig. 2
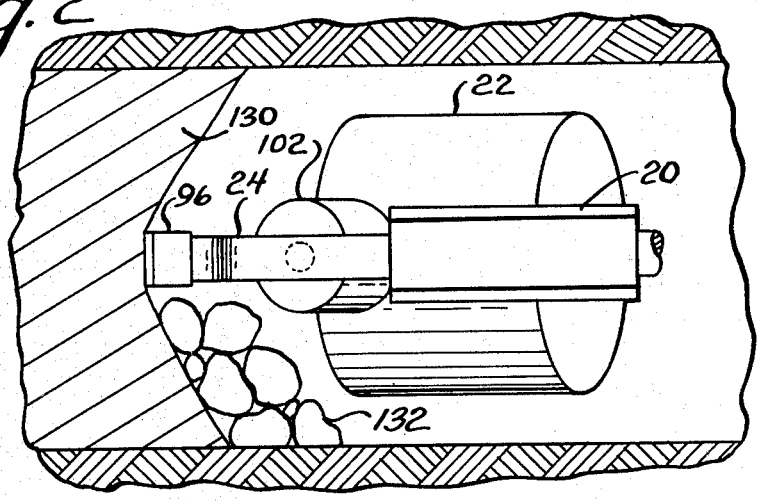

MECHANICALLY ACTUATED IMPACT MECHANISM

DESCRIPTION

1. Technical Field

The present invention relates generally to mechanically actuated impact apparatus adaptable for use in rock breaking, pile driving, pile extracting, and the like.

2. Background Art

Mechanically-actuated apparatus adapted for employment as rock breaking and fracturing devices are known for use in mining operations. One type of such apparatus is the rotating drumhead continuous miner in which a cutting element has a proximate edge which is turned to continuously place one or more of a series of cutting elements into contact with the work area to be cut away.

Another type of such apparatus uses a single impact hammer which is intermittently driven against the work area to fracture and break up rock and the like. Such single impact hammer apparatus includes those with a hammer reciprocable along a straight line and those with a pivoted hammer which is driven by an eccentric impact member rotated via a flywheel system to intermittently pivot the hammer outwardly against a work surface. Examples of the latter type are disclosed in Cobb et al U.S. Pat. No. 3,868,145 issued Feb. 25, 1975 entitled "Eccentric Ring Impacting Mechanism for In-Situ Rock Breakers" and Cobb U.S. Pat. No. 3,922,017 issued Nov. 25, 1975 entitled "Impact Material Fracturing Device for Excavators and the Like", both assigned to the assignee of the patent invention.

Rotating drumhead devices, in comparison to single shank impact devices, require more power for operation, cause greater quantities of dust and gas to be released because of the smaller size of broken material, tend to spark because of the continuous scraping against the work surface, and are relatively ineffective against medium strength rock, which must otherwise be drilled and shot. Single shank impact devices, in comparison to rotating drumhead devices, cannot be operated continuously and require that the impact tips be changed relatively often. It can thus be seen that either type of the above devices is not optimal, since each has certain advantages over the other.

DISCLOSURE OF INVENTION

The present invention is directed to overcoming one or more of the problems as set forth above.

In one aspect of the invention, a multiple output impact mechanism includes an arm movably supported on a frame, a housing mounted on the end of the arm with eccentric crankshaft and flywheel parts rotated by a motor, and a pair of shanks movable against the crankshaft so that they may individually be intermittently driven outward from the housing into contact with a work surface.

Biasing and dampening means maintain the shanks in spaced, disengaged relation to the crankshaft until the shank is moved positively against the work surface. The biasing and dampening means also absorb rebound energy after a shank has been driven against the work surface.

The advantages of such a construction are that the impact mechanism may be operated nearly continuously with twice the time interval between tip changes. Further, the impact mechanism breaks at a rate competitive with the rotating drumhead miner with reduced power, with less dust, gas and sparking, and with greater efficiency against hard rock.

In addition, the impact mechanism herein may be employed as a pile driver and extractor, unlike the rotating drumhead miner which cannot be so employed. When used as a pile driver and extractor, one shrank is used as a driver while the opposite link, when connected to an extractor link, is used as an extractor. Thus, little time or expense is expended in converting the mechanism from a pile driver to a pile extractor and vice versa.

BRIEF DESCRIPTION OF DRAWINGS

FIG. 1 is a top plan view of an embodiment of the present invention illustrating the operation of the impact head assembly in a mining environment;

FIG. 2 is an enlarged side elevation view of the invention shown in FIG. 1;

BEST MODE FOR CARRYING OUT THE INVENTION

Figure 3:
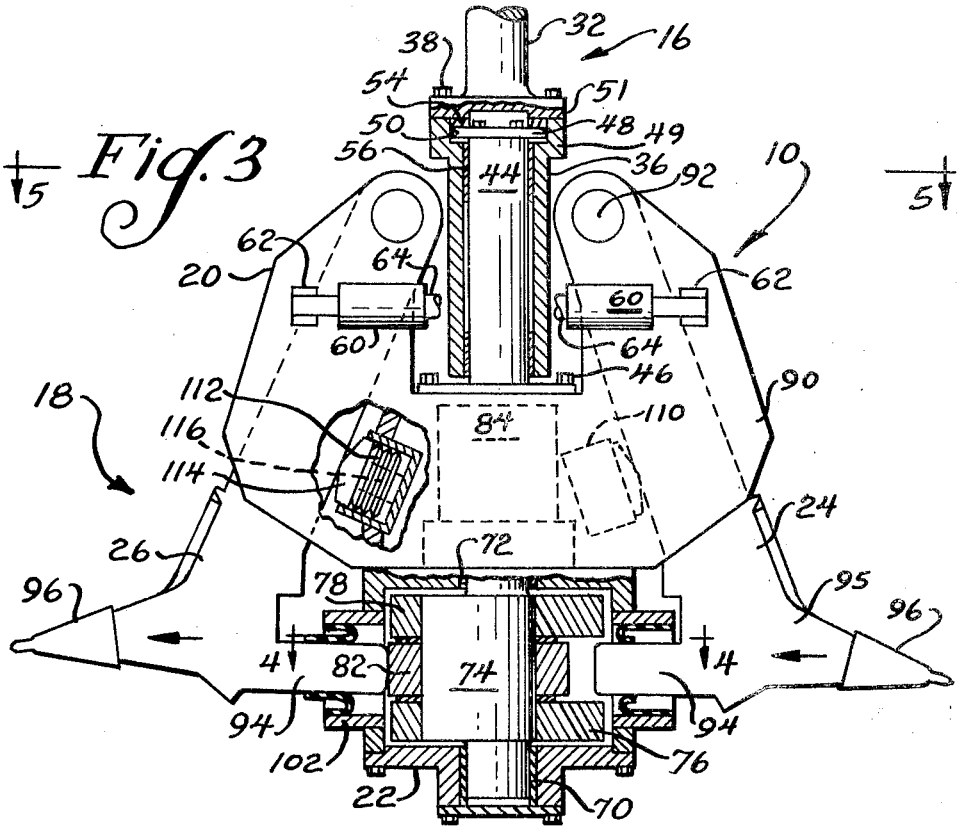
FIG. 3 is an enlarged plan view of the head assembly partially broken away to show internal components thereof.

As seen in FIG. 1, an impact mechanism, generally designated 10, is pivotally mounted on a movable support machine 12, by way of a support pin 14, which is illustratively shown herein as having a vertical orientation. The impact mechanism 10 broadly includes an articulated arm assembly 16 and a head assembly 18. The head assembly 18 has a housing defined by a shank tower 20 and a case 22, which pivotally mount a pair of opposed shanks 24 and 26, one at each side thereof.

The arm assembly 16 comprises a main shaft 30 joined to the support pin 14, a support shaft 32 pivoted to the main shaft 30 by wrist pin 34, and a support sleeve 36 fixed to the support shaft 32 by suitable means, such as bolts 38 (FIG. 3). Pivotal movement of the support shaft 32 about the wrist pin 34 is controlled by motor means, such as hydraulic cylinder 42 or by a gear motor (not shown) mounted on the shaft 30 which cylinder has an actuator 41 connected to a link 43 carried by the shaft 32. The shafts 30 and 32 are hollow so that hydraulic hoses for drive, lubrication and head rotation and water lines for tip cooling may be routed internally for protection against damage.

Figure 4:
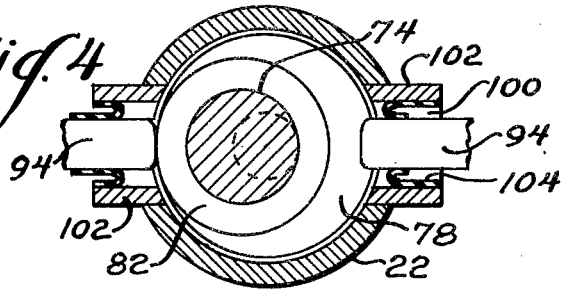
FIG. 4 is a fragmentary, cross-sectional view of the head assembly taken along line 4—4 of FIG. 3.
Figure 5:
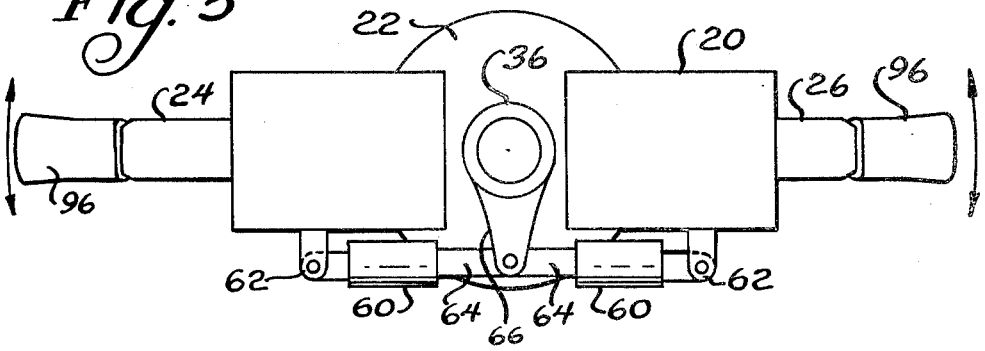
FIG. 5 is a rear view of the head assembly of FIG. 3 taken along the line 5—5 of FIG. 3.

The head assembly 18, as seen in FIGS. 3 through 5, is rotatably mounted on the free end of the arm assembly 16 by means of a support pin 44 which is disposed within the hollow support sleeve 36 and is secured to the shank tower 20 by bolts 46. A radially extending bearing plate 48 is bolted or otherwise secured to the inner end of the support pin 44 and resides within an annular groove 50 defined by an enlarged hub 49 on the support sleeve 36 and the flanged end 51 of the support shaft 32. Positioned about the bearing plate 48 and the support pin 44 are suitable thrust bearings 54 and radial bearings 56, respectively. Thus, the head assembly 18 is rotatable about the longitudinal axis of the support shaft 32, but axial movement therealong is prevented.

Rotation of the head assembly 18 is effected by motor means, such as rotator cylinders 60, as shown in FIGS. 3 and 5. The rotator cylinders 60 are respectively connected at opposite sides of the shank tower 20 by trunnions 62, while the respective piston rods 64 are connected to the support sleeve 36 through a trunnion 66, FIG. 5.

The case 22 is mounted adjacent the forward end of the shank tower 20. Rotatably mounted within the case 22 by spaced journals 70 and 72 is an eccentric crankshaft 74. Fixedly secured to the crankshaft 74 in spaced relation are a pair of massive flywheels 76 and 78 which counterbalance the eccentric crankshaft 74. Disposed between the flywheels 76 and 78 is an annular impact member 82 which is mounted by the eccentric portion of the crankshaft 74. The crankshaft 74 and, hence, the flywheels 76 and 78 and impact member 82, forming a part of the crankshaft 74, are rotatably driven by suitable means, such as hydraulic motor 84. The motor 84 is remotely powered by pressurized fluid so that a compact system is achieved with no shaft or linkage systems being required. The energy developed by the hydraulic motor 84 is stored in the massive flywheel system until delivery to the shanks through the crankshaft impact member 82, as described below.

The shank tower 20 has two pairs of spaced apart plates 90 between which the shanks 24 and 26 are located, the rearward end of each shank being pivotally supported by pivot pins 92. Defined at the free forward end of each shank 24 and 26 is a pin or stub 94 extending inwardly into the case 22 and a lateral shank extension 95 carrying a fracturing tip or point 96 extending in a direction outwardly away from the case 22 for engaging and fracturing rock and like materials. The pin or stub 94 extends through an opening 100 in an annular boss 102 so that the inner end, which is crowned to form an impact surface, may be contacted by the impact member 82. A suitable seal 104, which is shown as a resilient tube attached to the pin 94 and to the wall of the opening 100 in boss 102 is wound and unwound as the pin moves in and out relative to the boss 102 and is utilized to seal the opening 100 around the pin 94 to retain lubricating fluid within the case 22 and seal out dirt and other foreign matter. The seal 104 may be of the inflatable type or may be any other appropriate type. Thus, the pin 94 can reciprocate within the boss 102.

During operation, the crankshaft 74 will effect eccentric movement of the impact member 82, the impact member 82 thereby intermittently reacting against one of the shank pins or stubs 94 to drive that shank outwardly with the tip 96 pointed in the direction of such motion. As the tip 96 impacts rock or other work, the reaction of the rock against the tip 96 will cause the tip to rebound back toward the case 22. In order to prevent the tip 96 and shank 24 or 26 from moving back into the case too far or too fast, a biasing and dampening device 110 is employed.

The shank biasing and dampening devices 110 are carried by the shank tower 20 and are positioned to contact the inward edge of their respective shanks 24 or 26. The device absorbs shock forces placed on the shank when the shank 24 or 26 rebounds after impact with a work surface. Further, it prevents the impact member 82 from engaging the shank 24 or 26 except when the shank is urged positively into the case 22 and the impact member 82 is at a selected angular position. Each of the biasing and dampening devices 110 has Belleville washers or springs 112 which exert an outward force on the head portion 114, which contacts the shank 24 or 26. The springs 112 bias the shank 24 or 26 outwardly until a force on the shank overcomes the force of the spring as by moving the shank against the rock. After the shank 24 or 26 rebounds off the rock after impact, the head portion 114 causes a piston, which is attached to the head portion, to move into a cylinder (not shown). The cylinder is under pressure with a gas charge to absorb rebound energy. Once rebound energy is absorbed, the gas and the springs move the shank 24 or 26 outwardly once again. It should be understood that the non-working shank 24 or 26 is not impacted during operation, since it is held outward from the case 22 by the respective biasing and dampening device 110.

Figure 6:
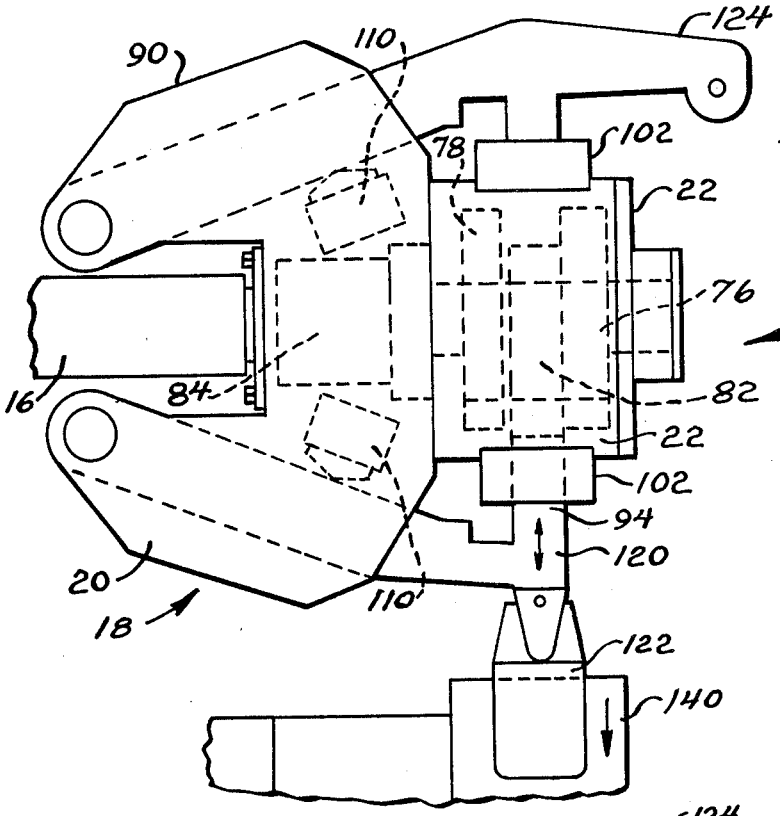
FIG. 6 is a side elevational view of the head assembly which has been rotated 90° and includes a pair of alternate shanks one of which is shown as being adapted for use as a pile driver; and, FIG. 7 is a side elevational view of the modified head assembly of FIG. 6 in which the other shank is shown as being adapted for use as a pile extractor.
Figure 7:
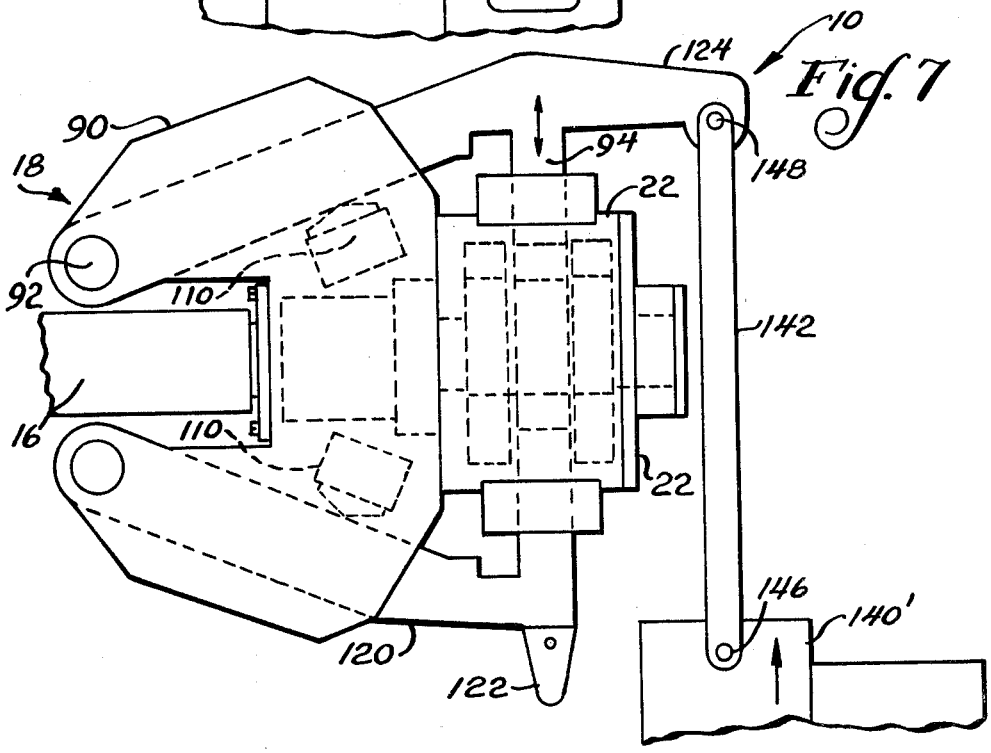

In FIGS. 6 and 7, the impact mechanism 10 includes a shank 120 having a driver tip 122 and an extractor shank 124. Note that both shanks 120 and 124, in either configuration, are always in place, although only one might be used at any particular time.

INDUSTRIAL APPLICABILITY

While it is comprehended that the impact mechanism 10, heretofore described, can be employed in a variety of applications, only two environments of use are illustrated herein.

In FIGS. 1 and 2, the impact mechanism 10 is used as a rock miner for underground mining and tunnelling. In FIG. 1, a top view, the head assembly 18 is moving counterclockwise along an arc of approximately nine feet to remove coal from a seam 130. The main and support shafts 30 and 32, which comprise the arm assembly 16, are maintained at the orientation shown with the impact angle A being held at approximately 35° while the head assembly 18 is rotated about the axis of the support pin 14. When the tip of shank 24 reaches point B, the head assembly 18 is rotated away from the rock about the wrist pin 34. This rotation, which is counterclockwise about 70°, positions the tip of shank 26 against the rock as seen in phantom in FIG. 1 so that a clockwise trip can be made across the face of the cut. The support machine 12 is then advanced slightly and the return cut is started. Thus, the impact mechanism 10 is almost in continuous operation with very little time wasted in maneuvering the setting up.

In FIG. 2, the head assembly 18 is shown working in a coal seam 130 about thirty inches high. Coal and other soft rocks should break completely from roof to floor in one pass as seen at 132 in FIG. 2. If more than one pass is required for harder rock, the head assembly 18 could be pivoted by operating the rotator cylinders 60 to rotate the shank tip attitude upward or downward about the axis of the support sleeve 36. This pivotal movement of the head assembly 18 also enables the shank tips 96 to be moved into areas which cannot be reached because of the fact that the head assembly 18 might be too wide. In addition, vertical movement of the support machine 12 from horizontal would allow work in seams substantially greater than thirty inches.

In FIGS. 6 and 7, the impact mechanism 10, in a modified configuration, is being used as an impact pile driver and extractor. To provide downward and upward forces, the head assembly 18 is rotated 90° with respect to the articulated arm assembly 16.

In FIG. 6, the pile-driver tip 122 of the shank 120 is placed in contact with a pile 140. The head assembly 18 is urged downwardly against the pile 140 to move the shank pin 94 into contact with the impact member 82. When the crankshaft and flywheel system is operated, intermittent impact force is transmitted through the shank 120 to the pile 140 to pound it down into place.

In FIG. 7, an extractor link 142 is attached, as by pins 146 and 148, between the pile 140' and pile-extractor shank 124. The head assembly 18 is urged upwardly away from the pile 140' to pull the shank pin 94 toward the case 22 into contact with the impact member 82 so that intermittent upward impact force is transmitted to the pile 140' to lift it from position.

Note that both shanks 120 and 124 can be left in place when pile driving or pile extracting. Only the extractor link 142 need be attached or removed when changing operations.

It is comprehended in most applications, that a 100 horsepower flywheel-crankshaft mechanism would be sufficient for proper operation of the impact mechanism 10.

Other aspects, objects and advantages of this invention can be obtained from a study of the drawings, the disclosure and the appended claims.

I claim,

1. An impact mechanism (10) mounted on a support (12), a head assembly (18) including a housing (20,22), a motor (84), a flywheel (76,78), an eccentric (74) turned by the motor, an impact member (82) on said eccentric (74), a pair of shank members (24, 26) pivotally mounted to the housing (20,22) at opposite sides thereof for swinging motion inwardly toward and outwardly from the housing (20,22), each of said shank members (24,26) having a first portion (95) adapted for work and a second portion (94) adapted to engage said impact member (82), and said flywheel energy being transmitted through the impact member (82) to one of said shank members (24,26) to intermittently move the shank member (24,26) outwardly from the housing (20,22) whenever the impact member (82) is turned and the shank member (24,26) is in engaged contact with the impact member (82).

2. In an impact mechanism (10) mounted on a movable support (12) and having a head assembly (18) including a housing (20,22), a drive motor (84) and flywheel and eccentric crankshaft system parts (74,76,78,82) turned by the motor, and an articulated arm (16) having one end movably mounted to the support (12) and having the opposite end mounting the head assembly (18), the improvement comprising:

a pair of shank members (24,26) pivotally mounted to the housing (20,22) at opposite sides thereof for swinging motion inwardly toward and outwardly from the housing (20,22), each of said shank members (24,26) having a first portion (95) adapted for work and a second portion (94) adapted to engage one of said crankshaft parts (82), flywheel energy being transmitted through said one of said crankshaft parts (82) to a shank member (24,26) to intermittently swing the shank member (24,26) outwardly from the housing (20,22) whenever one of said crankshaft parts (82) is turned and the shank member (24,26) is in engaged contact with said one of said crankshaft parts (82); and biasing means (110) carried by the head assembly (18) for exerting force on each of said shank members (24,26) tending to swing said shank members (24,26) outwardly from the housing (20,22) and out of engaged contact with said one of said crankshaft parts (82), whereby no impact energy from the flywheel system is transmitted to a shank member (24,26) until the shank member (24,26) is urged to swing inwardly into engagement with said one of said crankshaft parts (82) against the biasing force of said biasing means by placing the shank member (24,26) in pressure relation with work.

3. The impact mechanism of claim 2 wherein the head assembly (18) has a rearward end rotatably mounted at said opposite end of the articulated arm (16), and wherein the crankshaft part (82) is located generally adjacent the forward end of the head assembly (18), each of said shank members (24,26) having a rearward end pivotally connected to the head assembly (18) and having a forward end including said first portions (95) and said second portions (94) positioned in alignment with said crankshaft parts (82).

4. The impact mechanism of claim 2 wherein said biasing means (110) includes dampening means for absorbing rebound energy from said shank members (24,26).

5. The impact mechanism of claim 2 wherein each of said shank members (24,26) has a fracturing tip (96) mounted on its respective first portion (95), said tips (96) facing outward from the head assembly (18).

6. The impact mechanism of claim 2 wherein one of said shank member (24,26) has a pile driver implement (122) mounted on its respective first portion (95), said one shank member thereby functioning as an impact pile driver.

7. The impact mechanism of claim 2 further including a link member (142) and means (148) carried by one of said shank members for mounting said link member (142) thereto, said link member (142) being adapted to be attached to a work piece, said one shank member thereby functioning as an impact extractor.

8. (Rewritten in Independent Form) In an impact mechanism (10) mounted on a movable support (12) and having a head assembly (18) including a housing (20,22), a drive motor (84) and flywheel and eccentric crankshaft system parts (74–82) turned by the motor, and an articulated arm (16) having one end movably mounted to the frame (12) and its opposite end mounting the head assembly (18), the improvement comprising:

a pair of shank members (24,26) pivotally mounted to the housing (20,22) at opposite sides thereof for swinging motion inwardly toward and outwardly from the housing (20,22), each of said shank members (24,26) having a first portion (95) adapted for work and a second portion (94) adapted to engage the crankshaft part (82), flywheel energy being transmitted through the crankshaft part (82) to a shank member (24,26) to intermittently swing the shank member (24,26) outwardly from the housing (20, 22) whenever the crankshaft part (82) is turned and the shank member (24,26) is in engaged contact with the crankshaft part (82);

biasing means (110) carried by the head assembly (18) for exerting force on each of said shank members (24,26) tending to swing said shank members (24,26) outwardly from the housing (20,22) and out of engaged contact with the crankshaft part (82), whereby no impact energy from the flywheel system is transmitted to a shank member (24,26) until the shank member (24,26) is urged to swing inwardly into engagement with the crankshaft part

(82) against the biasing force by placing the shank member (24,26) in pressure relation with work;

means (36,44–50) for rotatably mounting the head assembly (18) to the articulated arm (16); and motor means (60–66) connected between the head assembly (18) and the arm (16) for effecting rotation of the head assembly (18) to selectively position said shank members (24,26) relative to the axis of the arm (16).

9. The impact mechanism of claim 8 wherein said mounting means (36,44–50) includes a support sleeve (36) carried at saidopposite end of the arm (16) defining annular groove (50) therein and a support pin (44) fixed to the head assembly (18) and adapted to rotate relative to said support sleeve (36), said support pin (44) having a bearing plate (48) positioned within said groove (50) preventing axial movement of said support pin (44) out of said support sleeve (36).

10. The impact mechanism of claim 8 further including motor means (42) connected between the parts (30,32) of the articulated arm (16) for controlling the attitude of the arm (16) and effecting swinging motion therebetween.

11. (Rewritten in Independent Form) In an impact mechanism (10) mounted on a movable support (12) and having a head assembly (18) including a housing (20,22), a drive motor (84) and flywheel and eccentric crankshaft system parts (74–82) turned by the motor, and an articulated arm (16) having one end movably mounted to the frame (12) and its opposite end mounting the head assembly (18), the improvement comprising:

a pair of shank members (24,26) pivotally mounted to the housing (20,22) at opposite sides thereof for swinging motion inwardly toward and outwardly from the housing (20,22), each of said shank members (24,26) having a first portion (95) adapted for work and a second portion (94) adapted to engage the crankshaft part (82), flywheel energy being transmitted through the crankshaft part (82) to a shank member (24,26) to intermittently swing the shank member (24,26) outwardly from the housing (20, 22) whenever the crankshaft part (82) is turned and the shank member (24,26) is in engaged contact with the crankshaft part (82);

biasing means (110) carried by the head assembly (18) for exerting force on each of said shank members (24,26) tending to swing said shank members (24,26) outwardly from the housing (20,22) and out of engaged contact with the crankshaft part (82), whereby no impact energy from the flywheel system is transmitted to a shank member (24,26) until the shank member (24,26) is urged to swing inwardly into engagement with the crankshaft part (82) against the biasing force by placing the shank member (24,26) in pressure relation with work;

the head assembly (18) has a rearward end rotatably mounted at said opposite end of the articulated arm (16);

the crankshaft part (82) is located generally adjacent the forward end of the head assembly (18);

each of said shank members (24,26) having a rearward end pivotally connected to the head assembly (18) and having a forward end including said first portions (95) and said second portions (94) positioned in alignment with said crankshaft parts (82);

each said shank members (24,26) has a fracturing tip (96); and said articulated arm (16) includes motor means (42) for controlling the attitude thereof and is pivotally mounted to the movable frame (12) to permit the head assembly (18) to be moved arcuately across a work surface, the articulated arm (16) being operable to present one tip (96) to the work surface at an acute angle of about 35 degrees as it is moved along a fixed arc in one direction and to present the other tip (96) to the work surface at an acute angle of about 35 degrees as it is moved along a fixed arc in the opposite direction, said impact mechanism thereby being capable of substantially continuous operation by arcuately moving the head assembly (18) back and forth across the work surface as the tips (96) are driven by the flywheel and crankshaft system (74–82) into said work surface for fracturing thereof.

* * * * *